United States Patent [19]

Lin

[11] Patent Number: 4,642,000

[45] Date of Patent: Feb. 10, 1987

[54] ANCHORING SYSTEM FOR CONCRETE FLOATING PIER

[75] Inventor: Tung Y. Lin, San Francisco, Calif.

[73] Assignee: The United States of America as represented by the Secretary of the Navy, Washington, D.C.

[21] Appl. No.: 757,402

[22] Filed: Jul. 22, 1985

[51] Int. Cl.[4] ..... E02B 3/20; E02B 17/00; B63B 21/00

[52] U.S. Cl. ..... 405/221; 405/195; 405/219; 114/263

[58] Field of Search ..... 405/195, 196, 200, 215, 405/218–221, 227, 282, 224; 114/230, 258, 263, 266

[56] References Cited

U.S. PATENT DOCUMENTS

| | | | |
|---|---|---|---|
| 1,672,102 | 6/1928 | Upson | 405/218 |
| 2,857,872 | 10/1958 | Usab | 405/219 X |
| 3,643,448 | 2/1972 | Bower | 405/219 |
| 3,668,875 | 6/1972 | Sander et al. | 405/219 X |
| 3,759,045 | 9/1973 | Nastasic | 114/230 X |
| 4,070,980 | 1/1978 | Shorter | 114/263 |
| 4,139,324 | 2/1979 | Krings | 405/282 |
| 4,217,848 | 8/1980 | Meyer-Haake | 405/221 X |
| 4,342,277 | 8/1982 | Sluys | 405/219 X |
| 4,365,914 | 12/1982 | Sluys | 405/219 |
| 4,497,593 | 2/1985 | Kramer | 405/212 |

FOREIGN PATENT DOCUMENTS

| | | | |
|---|---|---|---|
| 220711 | 8/1958 | Australia | 405/219 |
| 2528477 | 1/1977 | Fed. Rep. of Germany | 114/263 |
| 142806 | 11/1980 | Japan | 405/219 |

*Primary Examiner*—Cornelius J. Husar
*Assistant Examiner*—Nancy J. Stodola
*Attorney, Agent, or Firm*—Robert F. Beers; Joseph M. St. Amand

[57] ABSTRACT

The device is a floating pier with a sliding pile anchoring system arrangement that avoids rigid connections to the pier and allows the pier to rise and lower with the tides and to remain level during lateral displacement while avoiding substantial tilt or rotation of the pier during seismic and maximum static loading. Preferably, piles that are arranged in pairs and are spaced along the centerline of the floating pier ride in pile guide assemblies attached to the pier deck, and include shear fail means which operate during overload conditions.

9 Claims, 7 Drawing Figures

ANCHORING SYSTEM FOR CONCRETE FLOATING PIER

BACKGROUND OF THE INVENTION

The present invention relates to floating piers and particularly to a system for anchoring a concrete floating pier and similar marine structures.

Replacement of old, worn out piers can be more costly and time consuming than building new piers due to the time involved in removing the old pier before the new pier can be built. Because of this, the downtime for an operational pier can be on the order of 18 months. By replacing an old pier with a floating pier the downtime can be reduced by some 12 months if the new pier is built at an off-site location prior to demolition of the old pier. Only after the floating pier has been built, including outfitting with utility systems, is the old pier demolished. The new pier is then towed to the site and anchored in place. The short downtime for pier replacement benefits the shore facility because the major construction operations are conducted at a remote location.

The floating pier provides a structure well suited to berthing ships and servicing their needs. The floating pier structure rides the tides along with the berthed ships. This also permits the use of modern cell type fender systems where the fender is designed to contact a ship hull at the waterline because both the ship and pier move together with the tide.

An anchoring system for this new type of concrete floating pier must take into consideration tidal effects and other environmental conditions, such as currents, seismic loadings, static loads, seafloor soil conditions, etc. The floating pier must be anchored in place with a system which allows the pier to efficiently raise and lower with the tide and effectively withstand other environmental conditions, such as hurricane winds and strong currents. The pier anchoring system must also allow the pier to withstand seismic loads and permit the pier to remain level during lateral displacements.

SUMMARY OF THE INVENTION

It is an object of the invention, therefore, to provide a guide pile system for anchoring floating piers.

Another object of the invention is to provide an anchor pile system for floating piers which will withstand lateral displacements caused by seismic loads and by maximum static loads from huricane winds and currents.

A further object of the invention is to provide an anchor system for a prestressed concrete floating pier to restrain horizontal movement and allow the pier to remain level against lateral forces.

Other objects, advantages and novel features of the invention will become apparent from the following detailed description of the invention when considered in conjunction with the accompanying drawings.

DESCRIPTION OF THE PREFERRED EMBODIMENTS

Figure 1:
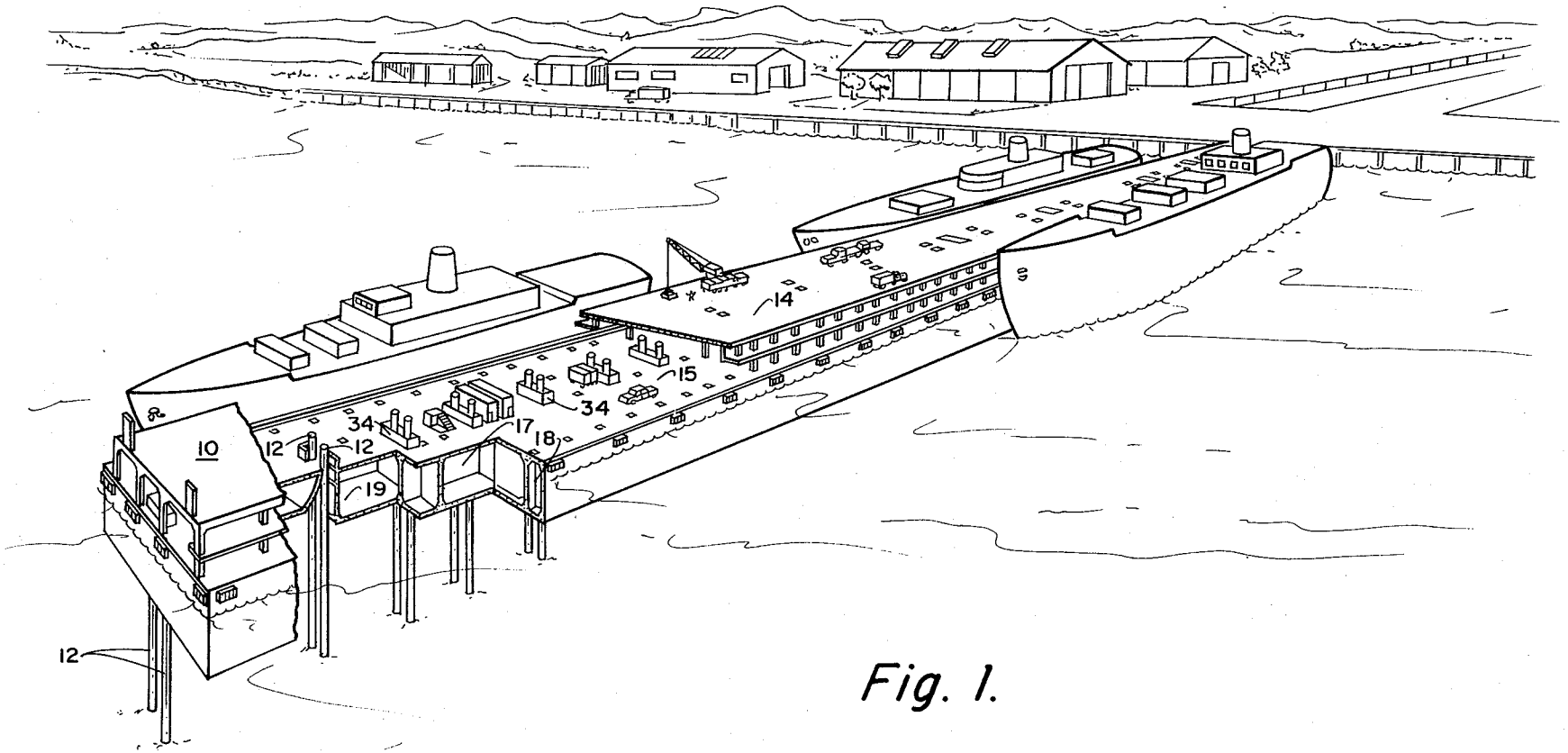
FIG. 1 is a perspective view of a floating pier system, shown partially in cut-away.

The anchoring system for the concrete floating pier uses guide-piles to restrain horizontal movement. The pier is free to move vertically with the tides. As can be seen in the overall view of the floating pier shown in FIG. 1, the pier 10 is anchored by means of vertical steel piles 12, shown in pairs spaced at intervals (e.g. every 40 ft. for a pier approximately 75 ft. wide) along the centerline of the pier. Several sections of pier can be connected together to form a longer or larger pier. Pier 10, as shown, has an upper deck 14 and a lower deck 15. Buoyancy chambers 17 and 18, for example, are located along the entire length of pier 10, and are formed from prestressed concrete, as are the major portions of the pier structure. Additional buoyancy chambers 19 are provided along the centerline of pier 10 between pile locations. The large number of buoyancy chambers (i.e. close compartmentation of the pontoon) in the pier provides for great deal of flotation redundancy.

After the pier is floated to its location, steel piles are installed in the seabed to anchor the pier in place, as shown in FIG. 1 for example. The restraining system at the pier-to-pile interface for the vertical steel piles comprises steel angle guide sections, attached to the pier decking, that ride on steel strips welded to the piles.

Figure 2:
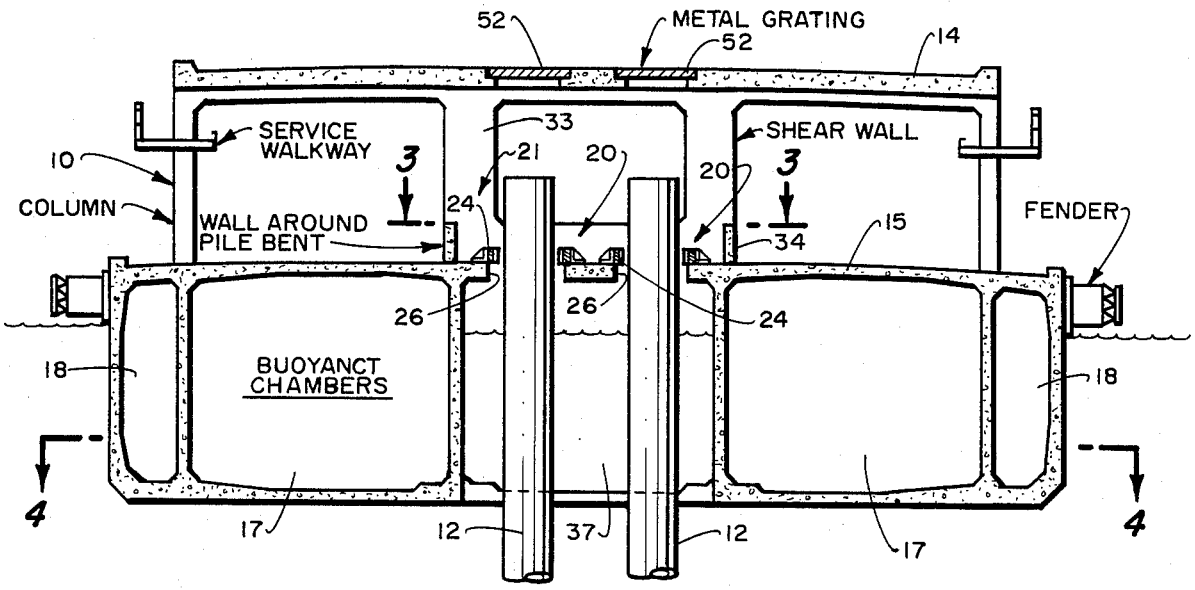
FIG. 2 is a typical vertical cross-sectional view of a concrete floating pier at the pile bent showing a side cross-sectional view of vertical piles guides and anchoring means.
Figure 3:
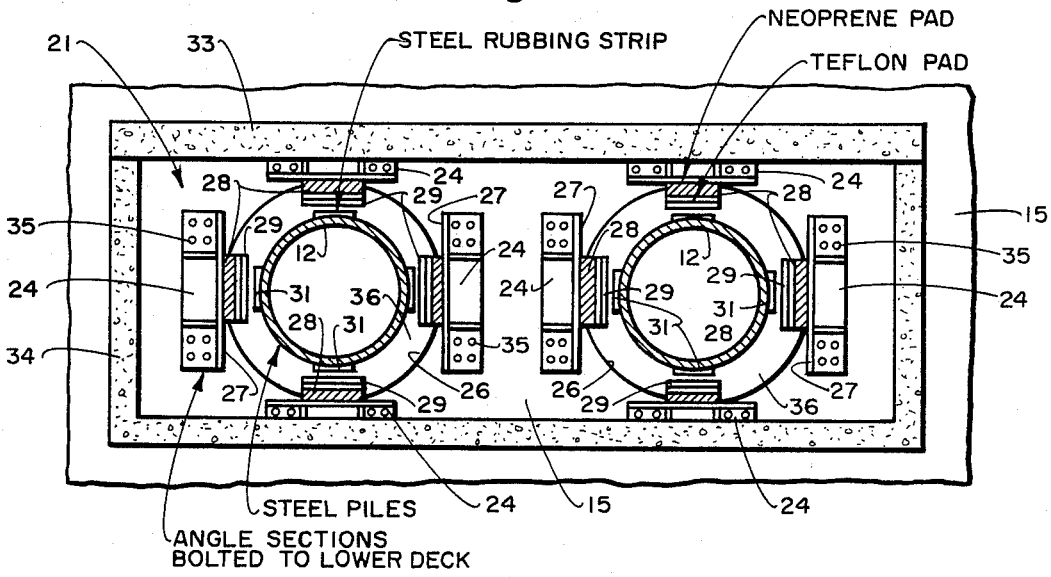
FIG. 3 is a cross-sectional plan view of the anchor piles guide system taken along line 3—3 of FIG. 2.
Figure 4:
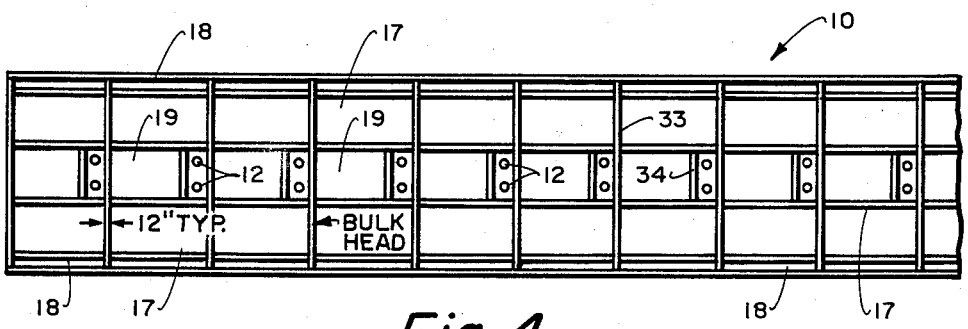
FIG. 4 shows a typical plan cross-sectional view of the concrete floating pier, taken along line 4—4 of FIG. 2.

The steel piles 12 contact pier 10 at the lower deck elevation 15 and are slideably secured to pier 10 with pile guide means 20, as shown in FIGS. 2 and 3, at each pile bent area 21. A plurality of angle sections 24 are bolted or otherwise fastened to lower deck 15 about each of the pile openings 26. A neoprene pad 28 is fastened to the vertical face 27 of each angle section 26, and each neoprene pad in turn has a Teflon pad 29, for example, attached to its outer surface. Steel rubbing strips 31 are mounted vertically about the steel piles 12, as shown. The Teflon pads 29 are used as glide plates which slide along the steel rubbing strips 31 as the pier moves upward or downward with the tide. As shown, a shear wall 33 of the pier structure forms a portion of wall 34 around each pile bent area 21.

The Teflon pads 29 which form efficient sliding contact faces with the pile rubbing strips 31 on the angle sections 26 are readily replaceable when worn. The neoprene pads 28 operate to absorb most of the impact forces. Bolts 35, attaching the angle sections to the pier decking, are designed to fail in shear during overload situations. It is preferrable for the bolts to shear than for the piles to buckle. In an earthquake condition, if the bolts shear, an additional space 36 (about 6 inches, for example) is permitted within pile opening 26.

With the arrangement as shown in FIGS. 1–4, piles 12 together with the guide arrangements 20 function as cantilever beams in restraining horizontal movement of the pier. The design lateral loads for the piles are determined by the worst case environmental conditions. Each pile acts as a spring in restraining the pier. The pier 10 is like a beam on an elastic foundation where the lateral response of the piles 12 are the elastic foundation. Chamber 37, a wet cell, through which piles 12 pass, is open to the sea at the bottom of the pier and allows room for flexing motion of the anchor piles as the pier moves against external horizontal forces.

Figure 5:
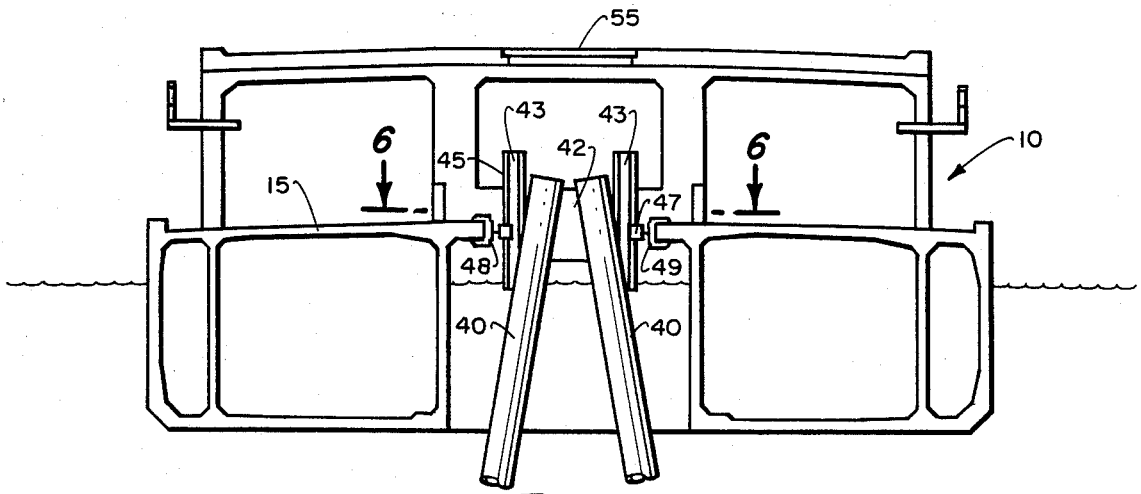
FIG. 5 is a vertical cross-sectional view of a concrete floating pier showing a batter piles anchoring system and piles guides.
Figure 6:
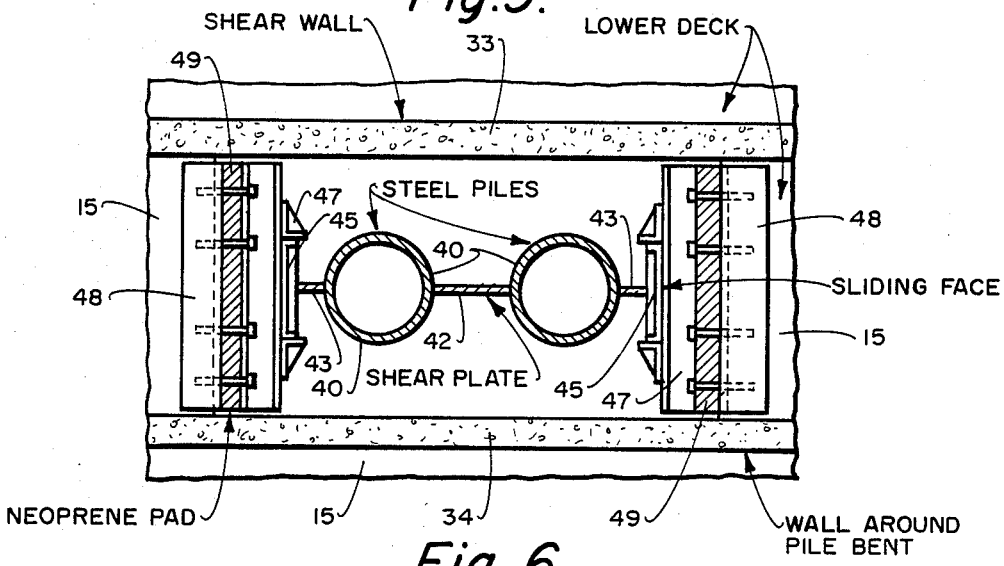
FIG. 6 is a plan cross-sectional view of the batter piles guide system taken along line 6—6 of FIG. 5.

Vertical piles 12 are filled with sand to increase their local buckling resistance and to provide corrosion resistance to the interior surface. The exterior of the piles are epoxy coated before the piles are installed. Cathodic protection is used for underwater portions of the piles.

Where it is desired to use batter piles, such as shown in FIGS. 5 and 6, a pair of piles 40 are joined together at their top by a shear plate 42. During overload situations, shear plate 42 is designed to fail rather than the piles buckle. Vertical I-beam sections 43 are welded to the non-vertical piles 40 to provide vertical rubbing surfaces or sliding faces 45. Guide brackets 47 provide a channels in which the sliding faces 45 of the I-beam sections ride as the pier rises and lowers with the tide. The guide brackets 47 are bolted, for example, to the pier decking 15 by a U-channel section 48 that fits about the decking at the pile bent opening. A neoprene pad 49 is mounted between guide bracket 47 and U-channel section 48 and operates to absorb impact forces, similar to pad 28 in FIG. 3. Good soil conditions are required when using batter piles for anchoring a floating pier because of uplift forces. The batter piles are filled with mass concrete to increase their dead-weight and assist in uplift resistance.

Should any damage occur to the piles from any source, a convenient system for pile replacement is provided. As shown in FIG. 2 metal gratings 52 are provided in openings in the top deck 14 of pier 10 directly above the vertical piles 12, and, as shown in FIG. 5, a metal grating 55 is provided in an opening in deck 14 directly above the batter piles 40. The gratings are readily removed to provide construction access to the piles and replacement thereof.

Figure 7:
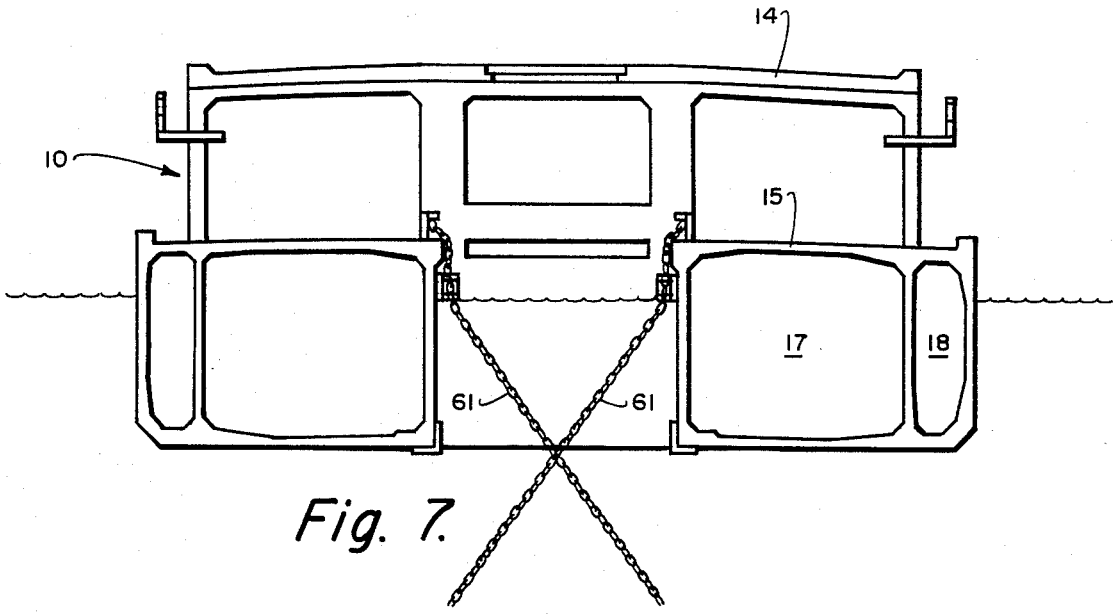
FIG. 7 is a vertical cross-sectional view of a floating pier, similar to FIG. 2, but using a crossed mooring chains arrangement for anchoring under special circumstances.

Vertical piles have the advantage of simple installation and large displacement under load. They act in bending only while batter piles act in bending and axial compression or tension. Batter piles are more efficient in steel utilization, and therefore are lighter in weight than vertical piles in direct comparison. However, this advantage is offset somewhat by their rigidity, which may be translated into a heavier fendering system. Batter piles also require more field installation work. Where difficult site conditions occur due to poor soils, deep water or large tidal variations, mooring chains 61, connected to the pier in a criss-cross fashion, as shown in FIG. 7, and secured to dead-weight concrete anchors or stake piles, not shown, can be used.

One of the advantages of locating the piles down the center of the pier is the avoidance of accidental contact between the piles and ship sonar domes and other apparatus on berthed ships which occaisionally occurs with conventional piers using wooden fender piles.

The anchor piles used are designed for the worst case soil conditions of soft clay, and to withstand lateral displacements caused by seismic loads and by maximum static loads from hurricane winds and currents. Recommended pile size for a 75 ft. wide pier, such as shown in cross-section in FIG. 2, is 48 inches in diameter with a wall thickness of 1.75 inches. The sliding pile guide connections, as hereinbefore described, permit the pier 10 to remain level during lateral displacement; whereas this could not occur if rigid connections were provided between the pier and the piles. A rigid connection between the anchor piles and the pier can cause the pier to rotate or tilt under lateral displacement. The tilt, or change in freeboard at the edge of the pier can be substantial. Any tilt that could cause small or large equipment to move is considered substantial from an operational standpoint. The sliding piles anchoring system, as described herein, does not cause the pier to tilt during lateral displacement and thus avoids the disadvantages of rigid pile connections. A close spacing of the piles can cause degradation of soil strength. However, if pile spacing is three to four times the pile diameter, the group effect is negligible. For the floating pier, as discussed herein, the piles are spaced at least three pile diameters apart so that pile group effect is minimal.

The floating pier 10, moves horizontally during ship impact, and uses the water environment to absorb a substantial portion of the ship berthing energy. Such movements displaces large volumes of water, which dissipates energy. The floating pier can better survive a major earthquake than the fixed pier. While the guide piles anchor the pier structure against horizontal forces, major ground motion could buckle the piles. However, the pier would still float and be operational. The damaged piles would provide some horizontal restraint until auxilary anchoring means could be installed. The floating pier can also be relocated within a harbor or to distant sites; such flexibility is precluded from present fixed piers. Horizontal loads on the floating pier located in a harbor environment are adequately resisted by approximately one-tenth the number of piles required for a fixed pier.

Obviously many modifications and variations of the present invention are possible in the light of the above teachings. It is therefore to be understood that within the scope of the appended claims, the invention may be practiced otherwise than as specifically described.

What is claimed is:

1. An anchoring system for a floating pier, the combination comprising:

a. a section of floating pier including deck areas and a plurality of enclosed buoyancy compartments for providing floatation thereof;

b. a plurality of rectangular wet cell compartments located along the centerline of said pier section with the longitudinal dimension of said compartment perpendicular to the pier centerline; said wet cell compartments being fully open to the sea at the bottom thereof;

c. the top of each of said wet cell compartments including opening means located in said pier deck areas for the installation and operation of pier anchoring means;

d. pier anchoring means installed in each of said wet cell compartments for anchoring said section of floating pier to the seafloor against horizontal forces while allowing said section of floating pier to rise and lower with the tide and also to remain level during lateral displacement thereof; said pier anchoring means comprising a pair of spaced apart vertical piles which glide vertically within pile guide means mounted in each of said wet cell compartments; the pile spacing of said pair of vertical piles being at least three pile diameters apart to avoid pile group effect; said pile guide means include a plurality of impact force absorbtion pads with glide plates on their outer surface which slide along said vertical piles; metal rubbing plates being mounted vertically along the outside of said vertical piles against which respective glide plates on said absorption pads slide;

e. said wet cell compartments allowing space for bending motions of said pier anchoring means when said floating pier section moves against horizontal forces;

wherein, said floating pier anchoring system provides effective anchoring for withstanding lateral displacements caused by seismic loads and maximum static loads due to high winds and currents.

2. A floating pier anchoring system as in claim 1, wherein said floating pier section is comprised of prestressed concrete.

3. A floating pier anchoring system as in claim 1, wherein said buoyancy compartments are located on each side along the entire length of the floating pier section and between each wet cell compartment along the centerline thereof.

4. A floating pier anchoring system as in claim 1, wherein servicing openings are provided above said wet cell compartments for installing and servicing said pier anchoring means.

5. A floating pier anchoring system as in claim 1 wherein said vertical piles are of steel filled with sand to increase their local buckling resistance and to provide corrosion resistance to their interior surfaces.

6. A floating pier anchoring system as in claim 1, wherein said batter piles are of steel filled with concrete to increase their dead-weight and assist in uplift resistance.

7. A floating pier anchoring system as in claim 1, wherein said pile guide means are mounted with shear bolts which are designed to fail in shear during overload situations and allow additional space for lateral movement of said piles within said at least one opening at the top of said wet cell compartments.

8. A floating pier anchoring sustem as in claim 1, wherein said pier anchoring means are mounted through respective openings in the top of said wet cell compartments along the centerline of said section of floating pier.

9. An anchoring system for a floating pier, the combination comprising:

a. a section of floating pier including deck areas and a plurality of enclosed buoyancy compartments for providing floatation thereof;

b. a plurality of wet cell compartments located along the centerline of said pier section; said wet cell compartments being fully open to the sea at the bottom thereof;

c. the top of each of said wet cell compartments including at least one opening located in said pier deck areas for the installation and operation of pier anchoring means;

d. pier anchoring means installed in each of said wet cell compartments for anchoring said section of floating pier to the seafloor against horizontal forces while allowing said section of floating pier to rise and lower with the tide and also to remain level during lateral displacement thereof; said pier anchoring means comprising a pair of batter piles joined together at the top by a shear plate and include a pair of vertical steel rubbing surfaces attached to said batter piles which operate to glide vertically within pile guide means mounted in said at least one opening at the top of said wet cell compartments; said pile guide means including a pair of impact force absorption pads with glide channels on their outer surfaces which slide along respective vertical steel rubbing surfaces on said batter piles as said floating pier section moves in a vertical direction;

e. said wet cell compartments allowing space for bending motions of said pier anchoring means when said floating pier section moves against horizontal forces;

wherein, said floating pier anchoring system provides effective anchoring for withstanding lateral displacements caused by seismic loads and maximum static loads due to high winds and currents.

* * * * *